United States Patent [19]

LaSalle

[11] Patent Number: 4,836,551

[45] Date of Patent: Jun. 6, 1989

[54] GOLF GAME UTILIZING A SHORTENED FAIRWAY HAVING FULL SCALE REALISM

[76] Inventor: Lowell L. LaSalle, 212 Courtland Cir., Carthage, Tex. 75633

[21] Appl. No.: 147,744

[22] Filed: Jan. 25, 1988

[51] Int. Cl.[4] ..... A63B 69/36

[52] U.S. Cl. ..... 273/185 B; 273/185 R

[58] Field of Search ..... 273/185 R, 185 A, 185 B, 273/186 R; 434/44

[56] References Cited

U.S. PATENT DOCUMENTS

| | | | |
|---|---|---|---|
| 3,501,152 | 3/1970 | Conklin et al. | 273/185 B |
| 3,514,871 | 6/1970 | Tucker | 434/44 |
| 4,150,825 | 4/1979 | Wilson | 273/185 B |
| 4,437,672 | 3/1984 | Armantrout et al. | 273/185 B |

FOREIGN PATENT DOCUMENTS

| | | | |
|---|---|---|---|
| 2110545 | 6/1983 | United Kingdom | 273/185 |

*Primary Examiner*—Leo P. Picard

[57] ABSTRACT

A system enabling a simulated golf game is set forth and includes a tee area opposite an upright screen having an image formed thereon to provide a simulated visual appearance of the golf hole. It is enclosed in a building having a ceiling of perhaps fifteen feet above the tee area with a ceiling portion sloping upwardly away from the golfer to permit the golfer to hit nine iron shots which are lofted toward the ceiling, the ceiling intercepting such shots and deflecting them away from the golfer. A sensor observes the flight of the ball and transmits the flight data to a CPU which computes the trajectory of the ball and its ultimate resting place or lie. A display apparatus communicates to the golfer the resting place of the ball on the fairway based on the calculations of the CPU. A separate approach area including a green with cup is used to complete the play of the simulated hole.

14 Claims, 2 Drawing Sheets

GOLF GAME UTILIZING A SHORTENED FAIRWAY HAVING FULL SCALE REALISM

BACKGROUND OF THE DISCLOSURE

This disclosure is directed primarily to a compact golf course which provides realistic play on a shortened area, a portion of which is enclosed by means of a building where the fairways can be markedly shortened to thereby reduce the terrain required for a realistic game of golf, and also reducing the time required to play the course, and further reducing susceptibility to bad weather.

Attempts heretofore to reduce the size or scale of gold courses have been made and are evidenced in various U.S. Patents. For instance, U.S. Pat. No. 3,712,624 is a system showing one mode of presentation of images to be projected on a screen erected in front of a tee box, thereby enabling a shortened course. U.S. Pat. No. 4,160,942 is a system for determining the trajectory of a golf ball which determines the ultimate resting point after a golf shot. The trajectory is calculated and the position of the ball on the course can thereafter be determined. U.S. Pat. No. 4,150,825 describes another type of trajectory determining system. The two patents of Miller (which are U.S. Pat. No. 4,192,510 and also U.S. Pat. No. 4,283,056) further depict a computer program for the proper handling of multiple golf holes from a driving tee, typically after each drive and ending up on a separate putting green. It is directed to a photographic system incorporating a driving tee at a driving range, with selected individual holes. Graphics are also provided.

In contrast with the foregoing systems, the present system utilizes a driving tee located within a building having an overhead roof such that the player in the game is able to use a variety of clubs in making the initial or tee shot; even more importantly, subsequent shots can be played from the same area, also in simulation of fairway shots, utilizing a variety of clubs, such that all the several shots simulate the drive and other approach shots to play a long hole. Even the shortest of holes can be played, namely, those where the tee shot is with a high angle iron wherein the loft of the shot will carry the shot against the ceiling of the building. This confines the tee shot to an area which permits the player to finish the game on a green that is immediately adjacent. The several shots toward the green area are determined in trajectory, and the ultimate position of the ball is defined whereby the golfer is able to putt out the hole. As will be understood, this entire procedure is a simulated golf game which can be accomplished in a relatively compact geographic area and which can also be played in a shorter interval.

One of the advantages of the present apparatus is the incorporation of a sloping roof over the tee area which extends forwardly to a screen. The screen and adjacent side walls provide an area wherein an image can be projected to simulate known fairways. The view from the tee box thus is realistic in that it is obtained from photographs which are converted into projected images on the screens. The sloping roof or ceiling permits the golfer to play the hole before the golfer in the ordinary fashion. While some holes may require a long straight drive, some holes may also require hitting a tee shot with greater loft. The trajectory of the ball is observed and recorded. Through suitable means, the lie of the ball is calculated and then displayed. This calculation determines the lie of the ball prior to the second shot. On longer golf holes where the lie of the ball may be on the fairway and short of the green, a second shot is then necessary. Utilizing a suitable inventory of intermediate photographic images, the golfer can then drive from the same tee box (without using a tee) thereby performing the second shot, and hitting the second shot with the club that would be selected based on the lie on the fairway. For instance, the second shot may involve a nine iron shot with substantial loft with a goal of dropping the ball onto the green with minimum roll. Another second shot may involve hitting the ball with a driver because the distance to be covered is still quite substantial. A variety of distances in between can likewise be accomplished wherein each shot is hit into a simulated image projected on the screen, and wherein each has a trajectory which carries the ball to an ultimate destination which is determined by means to be described and the lie of the ball on the course is determined. In summary, a simulated game is played in confined circumstances in a shortened interval.

One of the advantages of the present apparatus is the ability of the golfer to hit a high angle shot including a tee shot which is lofted and yet confined within a given area. Second or approach shots are also confined. The trajectory of the first and second shots are determined so that the lie of the ball on the fairway can be determined. After the necessary first and second shots have been hit and dependent on length, the ball is then positioned on the fairway or green so that putting out the hole can be accomplished. The long shots are accomplished in a covered building, and an indoor or outdoor green can then be used to complete the hole. The position of the ball relative to the pin on the green is determined and indicated to the golfer. One or more greens can be used. This enables simulation of a large golf course with nine or eighteen holes.

A variety of projected images can be used to simulate any number of fairways, and two or three greens can be used to simulate a variety of holes for the visually simulated golf course. Through the use of two or three contiguous driving areas, each confined within adjacent buildings, and through the use of adjacent putting areas, a nine hole or eighteen hole course can be simulated. The various advantages of the present apparatus and modes of use will become readily apparent upon a discussion of the detailed description given below.

BRIEF DESCRIPTION OF THE DRAWINGS

So that the manner in which the above recited features, advantages and objects of this invention as well as others which will become apparent are attained and can be understood in detail, a more particular description of the invention, briefly summarized above, may be had by reference to the embodiments thereof that are illustrated in the appended drawings, which drawings form a part of this specification.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
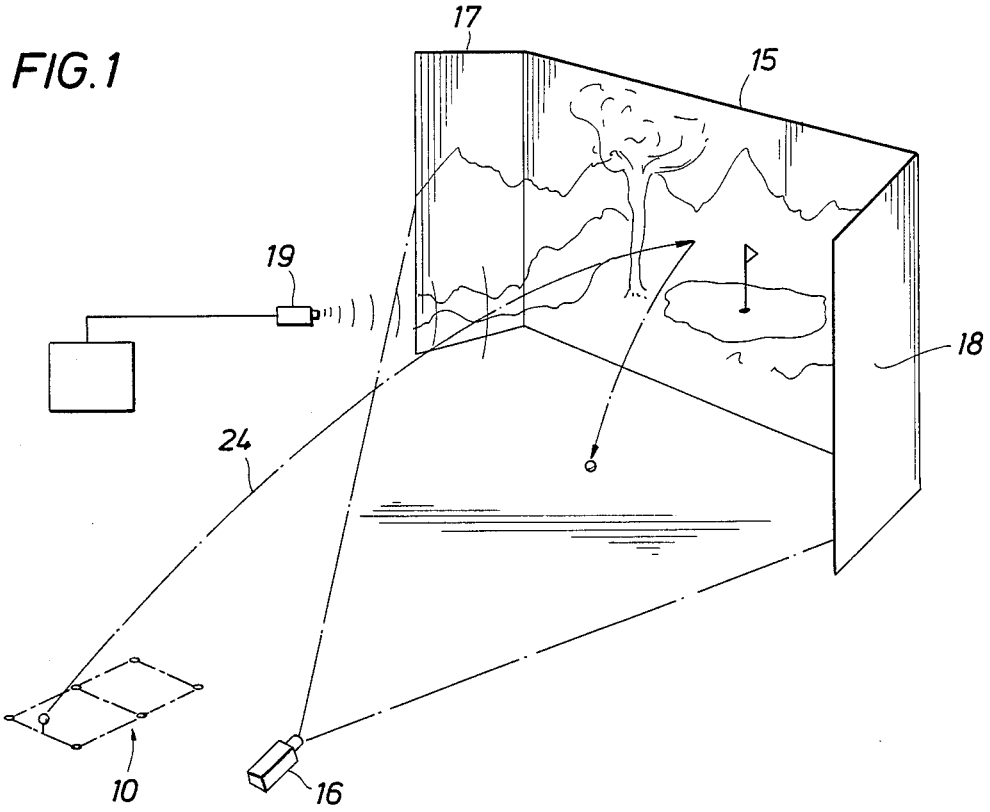
FIG. 1 shows a tee box wherein a golfer drives from the tee into a screen having an image thereon, the screen having sidewalls for additional imagery, and the path of the ball is determined so that the trajectory can be calculated.
Figure 2:
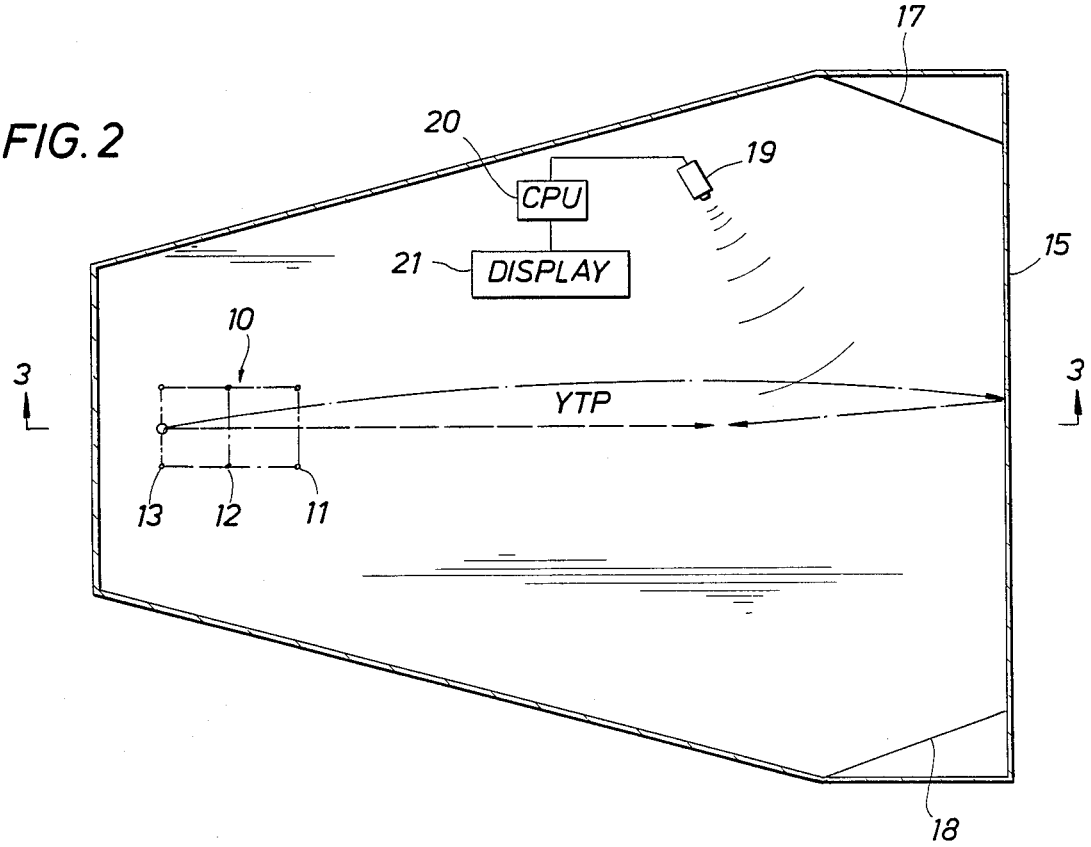
FIG. 2 is a plan view of the building having the tee box at one end and a screen at the opposite end wherein the sidewalls confine the golf ball during flight.

Attention is first directed to FIGS. 1 and 2 of the drawings considered jointly. There, a tee box 10 is illustrated having a short tee spacing 11, an intermediate spacing 12 and a long tee area 13. The tee box 10 is arranged opposite a screen 15. The screen 15 is upright, perhaps 50–80 feet from the tee box 10 and is made with a surface to provide a visual image to the golfer at the tee box. The image is projected onto the screen from a projector 16. The screen 15 includes side screens 17 and 18 which provide additional image area for the golfer at the tee box 10. The side screens 17 and 18 are set at an angle to the main screen 15 and extends back toward the golfer. They can be short or long depending on the scale and provide an enhanced visual field of view. The image that is seen on the screen is derived from the perspective from the golfer who is standing at the tee box 10 of some selected fairway.

Examples of an apparatus which determines the trajectory of a golf ball are set forth in U.S. Pat. No. 4,086,630 as well as U.S. Pat. No. 4,160,942, both incorporated by reference. Another such exemplary apparatus is shown in U.S. Pat. No. 4,150,825 incorporated by reference. Another such trajectory detection and measuring system is shown in U.S. Pat. No. 4,160,942. Such a system is incorporated in FIGS. 1 and 2. Primarily, this apparatus includes means for determining the path of travel in three dimensions of the golf ball. In any case, a sensor 19 is incorporated for detecting the path of the ball. Data from the sensor is used for determining the path of the ball. Data from the sensor 19 is input into a CPU 20 which is provided with a program for determining the trajectory of the ball. The trajectory of the ball coupled with the physical location of the tee box 10 enables calculations to be made and output through a display 21. A shown in FIG. 2 the distance from the tee box 10 is measured and indicated typically in yards and is represented by the symbol YTP which represents the number of yards to the pin. In typical full scale golf courses, the YTP can range from about 160 yards to about 500 yards. This data is stored for a particular hole in the CPU. Thus, the physical layout of the hole on the golf course is data which is input so that the YTP can be determined. As will be understood, YTP is measured from the pin to the hole. On many holes, this is a straight distance. On longer holes, the hole may have a dog leg, namely where the second shot around the bend to accomplish the turn into the dog leg. In either case, YTP is measured and input as a data for description of the golf hole.

The aforementioned YTP distance is not the only factor of importance. The fairway has a finite width and that is also input as part of the preliminary data describing the hole. So to speak, it represents an orthogonal or lateral area on either side of the line shown in FIG. 2. In an orthogonal sense, the two dimensions are X and Y which is useful in FIG. 4 to determine the actual location of the ball after it has been hit. The present apparatus determines the lateral position of the ball as a positive or negative value of Y which typically results from hook or slice in the drive. An artifice which can also be incorporated is the effect of a lateral wind. As will be understood, this can be encoded into the program for the CPU and thus provide deflection in the Y direction depending on the wind. If there is a head wind or tail wind, that also can be simulated in the ultimate determination of YTP. Another variable which can be incorporated is the undulations of the golf course. That is, one normally assumes that the tee 10 is at the same elevation as the green; however, relative height can be varied over a wide range. This variation also can be incorporated in the program handling trajectory determination. The primary requirement for the CPU 20 is to determine the trajectory of the ball after it has been hit so that the flight of the ball represented in the drawings by the numeral 24 can be determined. This determination is made notwithstanding the fact that the ball is interrupted by the screen 15. Thus, the trajectory is determined, which evaluation also measures the roll of the ball until it comes to rest on the fairway, on the green, or even on the rough adjacent to the fairway. The trajectory is thus determined taking into account the surface, namely, the fact that the grass may be cut short or quite rough. Moreover, the angle of drop likewise is determined. That is, if the shot is hit with a nine iron and thereby lofted, the shot may drop almost vertically and therefore have minimal roll. In fact, the nine iron shot is often used by skilled golfers to avoid rolling. On the other hand, if a low angle iron or wood shot is hit, the ball can roll for a long distance. All of these factors are determined in the CPU which calculates the placement of the ball after each shot relative to the particular golf hole being played by the user of the present apparatus.

The view which is projected from the projector 16 onto the screen 15 and adjacent side screens is in part determined by the position of the ball. That is, the first shot is hit from the tee box 10 and the view which is shown on the screen is the view which would be observed from that perspective on a selected golf hole. Assume that the perspective is that obtained from a par three hole. In that instance, the first shot is intended to land on the green and typically involves the use of a relatively high angle club. The projector places such an image on the screen prior to the shot, and after the shot, the CPU determines and displays the location of the ball relative to the pin; the hole is then played out on one of the putting green as will be described. By contrast, if the simulated hole is intended to be a par four hole of 350 yards, the first shot from the tee box (on a tee) is ideally hit, and located in the fairway as determined by the CPU 20. The CPU will determine that the first shot was a specified number of yards in length. In any case, location of the ball in the fairway or the rough is determined. The projector 16 is cued by the CPU to provide an image on the screen which depicts the scene that the golfer observes from that location short of the pin. The ball is next placed in the tee box 10 for the second shot which is a simulated shot from the fairway or rough. Thus, it is hit without a tee. The appropriate club is selected depending on the length of shot remaining, and the golfer is thus able to make that shot against the background depicted on the screen from the projector 16. This particular shot will typically land at or just short of the green at a location determined by the CPU 20 and again output by the display 21. That location is signaled through the display 21 to the golfer who then retrieves the ball which is in front of the screen 15 and places the ball on the putting green at the location indicated to finish th hole. This ball location, prior to the third shot, is directed by the data on the display in the form of XY coordinates relative to the pin. As will be explained with other views, the golfer is then able to locate the ball at the precise location indicated by the display and to finish play for that particular simulated hole.

Figure 3:
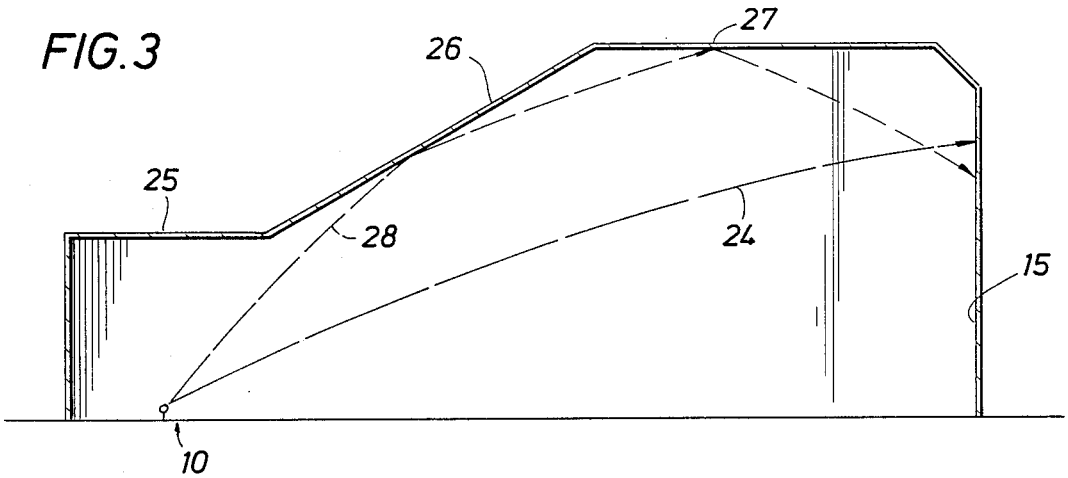
FIG. 3 is a side view of the building shown in FIG. 2 which incorporates a sloping roof to thereby enable lofted shots to be hit within the building.

Attention is now directed to FIG. 3 of the drawings which shows the tee box area 10 opposite the screen 15. The tee box is located at one end of a specially constructed building while the screen is at the opposite end. The screen 15 can optionally be raised and lowered. Equipment to raise the screen is somewhat more expensive, and a less costly construction is achieved as shown in FIG. 3 where the screen is erected permanently at one end wall of the building. In the area of the tee box, the overhead clearance of the building is about fifteen feet or so. This ceiling is identified by the numeral 25. The trajectory 24 of the golf ball to the screen is illustrated. Assume that this is the typical trajectory achieved with a driver. That trajectory carries the ball against the screen. The screen is ideally spaced at least about 50 feet from the golfer, and can be as much as 75–90 feet remote from the golfer. It is desirable that the screen stand a minimum of about 20 feet in height and more, to about 30–35 feet in height. An acceptable height is about 24 feet; the width likewise can vary and should be a mimimum of about 24 feet. A width of 30 feet appears to be optimum but it can also be increased substantially more than this. Scale factors of this sort assist the golfer in obtaining a desirable perspective so that the visual presentation of the image of the fairway is quite realistic. This realism is enhanced by the incorporation of the side screens to thereby permit a larger display which more or less expands the field of vision and tends to wrap around the golfer when standing at the tee box 10. This is sufficient to enable the golfer to get a proper feel for the visually presented hole and to hit the ball in the requisite fashion.

Returning now to FIG. 3, the trajectory 24 is that achieved with a low angle club such as a driver. The occasion may arise where it is desirable to hit a lofted shot. The ceiling or roof of the structure is angled upwardly at the portion 26. It ideally extends upwardly to permit a maximum height of 25 feet, but the height can be much greater such as a 40 foot ceiling. The ceiling portion 27 represents the maximum height ceiling. This height is somewhere between about 25 and 40 feet. If need be, the angle portion 26 can be simply made vertically if construction techniques permit. The elevated ceiling 27 the angled portion 26 together permit a lofted shot as exemplified by a nine iron shot. This trajectory is illustrated at 28. This lofted trajectory permits the ball to travel a sufficient distance so that the flight of the ball is properly observed by the detector 17 and sufficient data is obtained to determine the ultimate resting position of the ball.

One note of interest is the relative safety of the golfer in the confined building shown in FIG. 3. To this end, the ceiling portion 26 is preferably sloped so that the ball caroms away from the golfer after striking the ceiling portion. Similarly, the upright screen 15 is required to reflect the ball, but it is preferably made of a material which is not so hard as to cause a rebound back to the tee box 10. An exemplary screen is set forth in U.S. Pat. No. 4,150,825, or alternatively U.S. Pat. No. 3,591,184. In any case, all shots from the tee box area are deflected and carom in a safe fashion. The roof portion 26 and even the flat portion 27 forward of the tee box are arranged so that all shots can be made by the golfer from the tee box area and yet are intercepted, deflected, and fall to rest for easy retrieval. There is little likelihood of rebound so that the golfer is safe in the tee box area.

Figure 4:
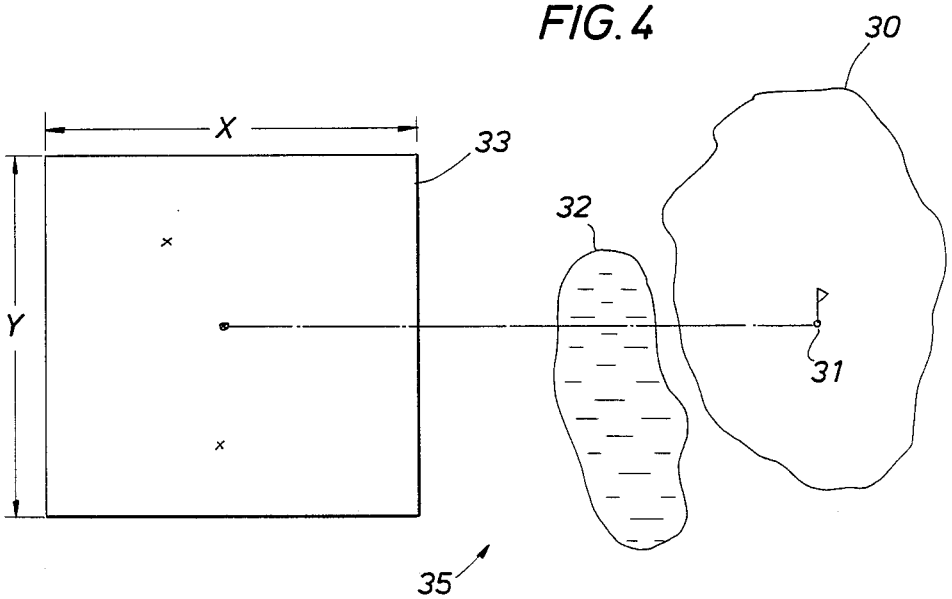
FIG. 4 shows an arrangement of a putting green relative to an area where the ball is spotted after determining the trajectory to permit the golfer to finish the hole by putting to the green.

Attention is next directed to FIG. 4 of the drawings. There, a putting green 30 has a pin 31 located somewhere in the green area. Conveniently, a hazard area is included at 32. The size of the green is typical, perhaps even larger than most green areas. The nature and size of the hazard can also be varied and can be constructed full scale. Immediately adjacent to the green area, an additional area is illustrated at 33. The area 33 simulates the end of the fairway. It has been drawn as a rectangle in FIG. 4 but it will be understood that it can have any shape so long as it appropriately simulates the end of the fairway. The green is covered with a putting surface which is normally, a particular species of grass suitable for putting greens. The area 33 is covered with grass or other fairway grasses. Typical grasses are tiff and bent grasses, grasses specially developed for golf courses. The hazard 32 is typically a sand pit or alternatively a water hazard. Conventional surfaces are thus presented to the golfer. Areas adjacent to the area 33 can be covered with rough grass cut to any height such as two to five inches typical for a rough areas.

An important factor relating to the green and the area 33 is the XY coordinate system which is interposed over this area. The XY coordinate system serves as a means of defining the precise location of the ball after the green has been approached. Thus, this arrangement can be used for any length of simulated hole. The green 30 represents a green for a par three hole or a long par five hole. The area 33 represents the area immediately adjacent to the hole. After the first shot has been hit, the position of the ball relative to the pin (the remaining YTP) is determined, and the display provides the location of the ball. The ball is spotted in the area 33 at the described X and Y locations. As will be understood, it is helpful to mark the area 33 with distances or other symbols so that the golfer knows where to spot the ball. The position of the ball is determined by the CPU and output at the display 21. The golfer then spots the ball as instructed and then finishes the hole. Assume, in a typical situation, that the ball is somewhere in the area 33. The golfer is then confronted with the conventional approach shot at or over the hazard 32. The ball is played in the conventional fashion from the area 33 to the green 30. Moreover, this play must take into account the nature of the surface as well as the threat of the hazard 32. Ordinary dimensions are utilized in the green 30 and the hazard 32 so that full scale challenges are presented to the golfer from this location.

The area 33 is particularly useful in positioning the ball before the green. Assume that the golfer has hit the ball over the green in the simulated calculations determined by the CPU. In that instance, the ball would land on the far side of the green. The area 33 can be used to simulate this type of overshot. Thus, if the ball falls short or goes over the green, the area 33 can be used in either instance. If greater surface area is available, the area 33 can be replicated to the left and right of the green 30 so that additional potential locations can be used should the golfer stray out of the fairway. Assume as an example that the golfer's approach shot is located by the CPU at a distance of 20 yards to either side of the pin 31. In this instance, the green area 30 can be flanked by roughage area to permit the golfer to play out the hole from that location. In general terms, the width of the green presented to the golfer can be varied as a scale factor, and can be increased to the extent that surface area is available.

The approach area 33 in conjunction with the green 30 shown in FIG. 4 combines to define an area which can be as narrow as about 40 feet and as short as about 60 feet. On the other hand, its width can be increased easily to about 10 feet while its length can be as much as about 250 feet. These dimensions describe relatively wide ranges for the area which is landscaped and surfaced to function as a full scale golf course. This approach area is identified by the numeral 35 and is denoted by the term "Approach Area". The approach area includes the end of the fairway at 33 and the green 30 with appropriate hazards.

Figure 5:
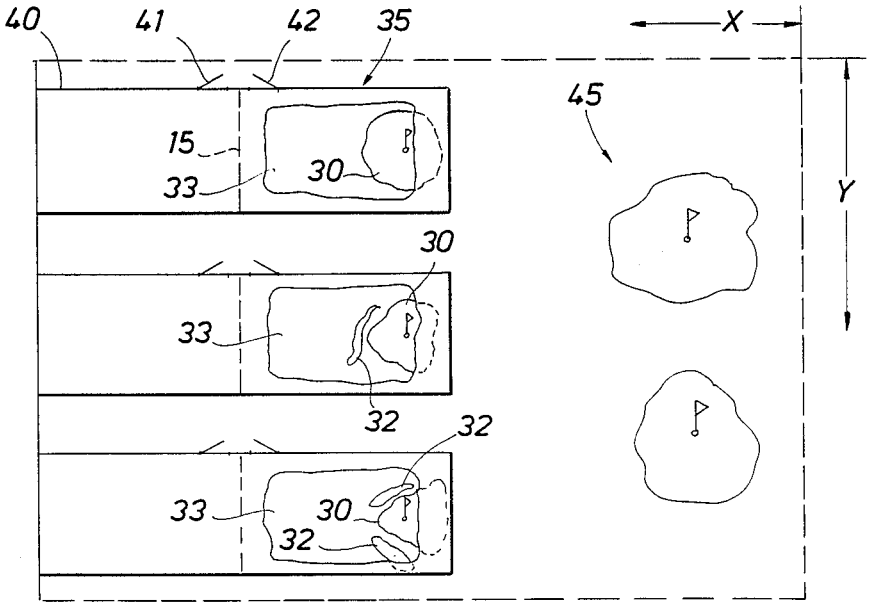
FIG. 5 is a plan view of a plot of ground having multiple tee areas and multiple greens to enable simulation of a nine hole or eighteen hole golf course.

FIG. 5 of the drawings shows a building 40 which is constructed in accordance with the teachings of this disclosure. The building 40 is shown in plan view. The building 40 includes a first indoor driving area terminated by the screen 15. This is replicated any number of times, three being a typical situation as shown in FIG. 5. The building 40 is constructed with the indoor driving range fully enclosed and terminating at the screen 15. After it has been used, the golfer can exit by a door 41 and go to the adjacent approach area 35 passing through a door 42. The approach area 35 is thus enclosed indoors and is located immediately adjacent to the screen 15.

The building 40 includes three fully enclosed tee box areas with screens 15 opposite them. As will be understood, only a single tee box and screen will suffice to simulate many holes. The simulation is obtained primarily in the images projected onto the screen. The imagery on the screen is as varied as the photography which forms the images and thereby permits the golfer to see or observe a great variety of situations. On the other hand, the approach areas 35 can be constructed differently as shown in FIG. 5. For instance, they can be constructed with no hazard, a central hazard, or flanking hazards adjacent to the green. The greens can be constructed differently in size or undulations. In fact, the great variety obtained for the simulated golf course is measurably enhanced by the incorporation of varied greens in the three approach areas. FIG. 5 shows three separate approach areas enclosed within the building 40. In addition to that, outdoor areas are included. The numeral 45 identifies an outdoor area immediately adjacent to the building 40 which includes one or more green areas and appropriate hazards. Again, it is preferably marked or coded with XY coordinates to enable the golfer to locate the ball after simulated shots in the enclosed area. In utilizing the outdoor area 45, the golfer first hits the tee shot on the inside of the building, and the position of the ball is ultimately determined by the CPU and a signal is then flashed to the golfer directing the golfer to spot the ball at a particular XY location. This location is determined for the approach area 35 which is either enclosed within the building 40 or which is located in the immediate adjacent area 45. The area 45 can be as large or as compact as space will permit. Utilizing the compact arrangement shown in FIG. 5, a simulated golf course of nine or eighteen holes can then be obtained. It can be played simultaneously by several users. A single golfer or a foursome can utilize the indoor driving area, all playing a common hole, and all utilizing a common approach area 35. After the initial tee shots have been hit against the screen 15, second shots are then taken if required because of the length of the simulated fairway. Ultimately, the foursome is directed to move to the approach area 35 for the simulated hole. That move requires that the foursome spot their respective balls at XY determined locations. These locations are indicated to the golfers. The balls are then spotted at the determined locations relative to the green, and the golfers are then required to finish the simulated golf hole by putting to the pin 31. Putting is accomplished under realistic circumstances, namely on a green area which is constructed with conventional grass and which has typical undulations in the surface. In fact, the pin can be moved on a daily basis as is ordinarily done on many golf courses.

A foursome can play a simulated eighteen hole course by using just a few approach areas. While an approach area may be used three or four times during a simulated eighteen hole course, it really responds differently because it is located at the end of a fairway that can be simulated having different lengths with different dog legs. In other words, a particular green area is, by simulation, located at the end of markedly different fairways. The tee shots and fairway shots which bring the ball toward the green are entirely different.

Depending on the inventory of photographic images available, an endless variety of golf holes can be simulated. This variety therefore permits the golfers to use the illustrated apparatus without tiring of the simulated course which is presented to them. The number of simulations can be increased substantially without limit.

As noted earlier, significant advantages attaching to the present simulated golf system include a reduction in the size of the golf course. It is not uncommon for a golf course to cover 300 acres or more. In the present instance, the golf course can be reduced to just a few acres and can range anywhere from about one acre to about ten acres in total area. Also, the time required to play the course is markedly reduced. Further, the golf course is adaptive in the sense that many simulated holes can be presented. This variety of simulated holes enables expansion of the golf course to provide simulation of courses all around the world including those that are most famous.

While the foregoing is directed to the preferred embodiment, the scope thereof is determined by the claims which follow.

I claim:

1. A system providing a simulated golf game for a user comprising:

(a) at least one building having an indoor driving section ending at an upright screen;

(b) a tee area positioned in said indoor driving section of said building, said tee area enabling a user to hit a ball using the full range of clubs customarily available for tee shots, said building confining the tee shot with an overhead ceiling and said ceiling has a first section positioned over said tee area and substantially parallel to the floor, a second angled section connected to said first section and positioned immediately in front of said tee area to deflect golf balls away from said tee area and towards said screen, a third section connected to said second section positioned opposite from said tee area and substantially parallel to said floor;

(c) said upright screen having an image forming surface facing said indoor driving section of said building wherein said screen is spaced from said tee area to intercept the tee shot;

(d) a simulated approach section at the end of a fairway positioned remote from said driving section of said building;

(e) a green area having a cup therein, said green area positioned adjacent to said end of fairway of said approach section;

(f) trajectory computing means for determiming the flight of the ball hit from said tee area said trajectory computing means operative in said indoor driving section of said building; and (g) said trajectory computing means determining the position of the ball after the tee shot dependent on the range and direction of the tee shot, said means further determining ball position relative to said green area as part of a simulated golf hole having a tee area and green area, said means indicating a specific ball placement prior to completion of the simulated golf hole by the user.

2. The system of claim 1 wherein said tee area has length and width, thereby enabling multiple tee positions within said tee area to thereby define long and short tee positions.

3. The system of claim 1 wherein said tee area is spaced from said upright screen by a distance sufficient to enable the ball hit from said tee area to have trajectory to enable said trajectory computing means to determine the flight of the ball extended beyond said screen, and wherein image projector means forms an image on said screen which has the appearance of a golf hole as viewed from said tee area.

4. The system of claim 3 including said image projector means to form an image on left and right side screens to present to the user left and right views of the fairway of a simulated golf hole, wherein images placed on said left, said right and said upright screens comprise an image from the simulated golf hole as viewed from the tee area thereof.

5. The system of claim 1 wherein said trajectory means determines the trajectory of a shot from said tee area which first strikes either said screen or said ceiling.

6. The apparatus of claim 5 wherein said sidewalls confine tee shots from said tee area, said tee shots being deflected so that the ball does not escape the area between said tee area and said screen and is retrievable by the user.

7. The system of claim 6 wherein said trajectory means detects flight of the ball and determines trajectory including loft of the ball during flight, direction of the ball, curving of the ball during flight to the left or right and roll after the flight of the ball.

8. The system of claim 1 wherein said trajectory computing means determines the position of the ball after the tee shot wherein the position is located along the fairway of a simulated golf hole and provides an indication to the user to hit a second shot from said tee area in simulation of an approach shot toward said green area, and further wherein first and second images are placed on said upright screen wherein said first image is the image obtained from the tee area of the simulated golf hole, and said second image is the image obtained from the fairway of said simulated golf hole.

9. The system of claim 1 further including at least one hazard in said indoor approach area positioned between said green area and said end of fairway.

10. A system providing a simulated golf game for a user comprising:

(a) at least one elongate building having walls, a ceiling and a floor;

(b) a tee area positioned on one end of said elongate building;

(c) said walls, ceiling and floor of said elongate building arranged about said tee area to enable a user to hit a ball using the full range of clubs available for tee shots;

(d) a screen mounted on an interior wall of said building at the opposite end of said building from said tee area, said screen having an image forming surface and said ceiling has a first section positioned over said tee area and substantially parallel to the floor, a second angled section connected to said first section and positioned immediately in front of said tee area to deflect golf balls away from said tee area and towards said screen, a third section connected to said second section positioned opposite from said tee area and substantially parallel to said floor and in front of said screen;

(e) at least one outdoor approach area including an end of fairway, a green area and a cup positioned in said green area;

(f) trajectory computing means for determining the flight of the ball hit from said tee area; and (g) said trajectory computing means determining the position of the ball after the tee shot dependent on the range and direction of the tee shot, said means further determining ball position relative to said green area as part of a simulated golf hole having a tee area and green area, said means indicating a specific ball placement prior to completion of the simulated golf hole by the user.

11. The system of claim 10 further including at least one hazard in said outdoor approach area positioned between said green area and said end of fairway.

12. A simulated golf course providing a nine hole course for use by a golfer wherein the total area involved in simulation is reduced, the golf course comprising;

(a) plural enclosed driving areas, each thereof having:

(1) a tee box area for hitting a golf ball in simulation of teeing off at a hole;

(2) an upstanding screen spaced from said tee box for intercepting a golf ball tee shot from said tee box;

(3) wherein said screen also responds to an image projected thereon to provide a simulated view from a tee box area;

(b) separate plural approach areas including greens with cups therein, said approach areas including varied green surfaces and hazards; and (c) wherein said driving areas and approach areas form, in combination, a set of nine golf holes all of which have a tee box enabling a simulated tee shot to be hit against said screen and further wherein said approach area enables putting out the nine golf holes wherein each one of the nine golf holes is different from the remaining eight golf holes.

13. The apparatus of claim 12 wherein said approach areas are defined by an XY coordinate system to enable means to spot the golf ball relative to a simulated golf hole after hitting the golf ball from said tee box such that play begins at one of said enclosed areas and finishes by putting on one of said approch areas.

14. A simulated golf course providing a nine hole course for use by a golfer wherein the total area involved in simulation is reduced, the golf course comprising:

(a) plural enclosed driving areas, each thereof having:

(1) a tee box area for hitting a golf ball in simulation of teeing off at a hole;

(2) an upstanding screen spaced from said tee box for intercepting a golf ball tee shot from said tee box;

(3) wherein said screen also responds to an image projected thereon to provide a simulated view from a tee box area;

(4) a multisection ceiling over said driving area extending from said tee area and having a section sloped in front of said screen to deflect golf balls away from said tee area;

(b) separate plural approach areas including greens with cups therein, said approach areas including varied green surfaces and hazards; and (c) wherein said driving areas and approach areas form, in combination, a set of nine golf holes all of which have a tee box enabling a simulated tee shot to be hit against said screen and further wherein said approach area enables putting out the nine golf holes wherein each one of the nine golf holes is different from the remaining eight golf holes.

* * * * *